US006117509A

United States Patent [19]

Lee

[11] Patent Number: 6,117,509

[45] Date of Patent: Sep. 12, 2000

[54] ADHESIVE LABEL AND MANUFACTURING METHOD THEREOF

[75] Inventor: Ji-hoon Lee, Seoul, Rep. of Korea

[73] Assignee: Samsung Display Devices Co., Ltd., Suwon, Rep. of Korea

[21] Appl. No.: 08/705,942

[22] Filed: Aug. 29, 1996

[30] Foreign Application Priority Data

Aug. 30, 1995 [KR] Rep. of Korea ..... 95-27352

[51] Int. Cl.[7] ..... G09F 3/02

[52] U.S. Cl. ..... 428/40.1; 283/81; 428/40.4; 428/40.9; 428/41.1; 428/41.4; 428/41.5; 428/323; 428/329

[58] Field of Search ..... 428/40.1, 40.9, 428/40.4, 41.1, 41.4, 41.5, 41.8, 42.1, 323, 329, 473.5; 273/81

[56] References Cited

U.S. PATENT DOCUMENTS 4,775,786 10/1988 Yamano et al. ..... 235/490
4,971,858 11/1990 Yamano et al. ..... 428/323
5,262,470 11/1993 Shimotsuma ..... 524/496
5,273,798 12/1993 Miner ..... 428/473.5
5,506,016 4/1996 Onodera ..... 428/40.9

FOREIGN PATENT DOCUMENTS 0601317 6/1994 European Pat. Off. .
601317 6/1994 European Pat. Off. .

*Primary Examiner*—Nasser Ahmad
*Attorney, Agent, or Firm*—Rothwell, Figg, Ernst & Kurz

[57] ABSTRACT

A label sheet which is formed by stacking an adhesive layer, an inorganic reinforcement layer, a polyester film layer and a bar-code print layer on a releasable substrate layer in sequence is provided. According to the present invention, a glass frit is added to the adhesive layer of the label sheet, and not to the bar-code print layer, so that problems caused from the glass frit in the bar-code print layer can be eliminated and the adhesive layer itself can fix the shape of the label sheet. In addition, thermal stability at high temperatures is improved by the characteristics of individual layers constituting the label sheet, so that the bar-code is not damaged by a thermal process.

9 Claims, 1 Drawing Sheet

ADHESIVE LABEL AND MANUFACTURING METHOD THEREOF

BACKGROUND OF THE INVENTION

1. Field of the Invention

The present invention relates to an adhesive label sheet and a manufacturing method thereof, and more particularly, to an adhesive label sheet which can be attached to articles to be produced through a high temperature firing furnace or to be subjected to indirect heat treatment at high temperature, and a manufacturing method thereof.

2. Description of Related Art

Conventionally, when attaching identification labels to articles such as ceramics, electronic substrates, or cathode ray tubes which must pass through a firing furnace or an electric furnace in the manufacturing process, these identification labels should be attached to articles cooled after the high temperature furnace process since they are likely to melt away or burn at high temperature. Using this method, however, it is difficult to recognize information on the articles before the furnace process. Accordingly, these conventional labels are not sufficient for identification labels such as bar-code labels.

The conventional identification label includes a substrate layer having good release properties, an adhesive layer and an ink-receiving layer. These labels are attached to articles by an adhesive force of the adhesive layer while the substrate layer is separated by an automatic process. Thus, if the adhesive layer melts or deforms, it is difficult for the bar-code to be recognized. The adhesive layer, as an important constituent of the label sheet, should be stable at high-temperatures, i.e., in a firing furnace, and adhere firmly to the articles.

A related prior art bar-code label based on ceramics is disclosed in U.S. Pat. No. 4,775,786. In accordance with the teaching of that patent, the material used in the label is fragile during the drying process due to a lack of flexibility, and requires a lengthy drying time and is costly.

Further, a pattern formation sheet and a manufacturing method thereof are disclosed in U.S. Pat. No. 4,971,858. In that patent, the ink-receiving layer of the sheet includes a glass frit in addition to a metal powder, a metal oxide powder and an organic binder. The fused glass frit may be attached to an article or the bar-code which may be damaged due to air bubbles generated by the glass frit. Further, the label manufacturing process is complicated and the manufacturing cost is also high.

Also, European Patent No. 0 649 126 Al discloses a label which includes a film composed of a silicone resin, an inorganic monocrystalline fiber and an adhesive wherein the adhesive is made of a silicone resin and metal powder. However, the adhesive is not stable at high temperatures and the adhesiveness thereof is not desirable.

SUMMARY OF THE INVENTION

To solve the above problems, it is an object of the present invention to provide a label sheet which can function as a bar-code and which is not damaged by exposure to high-temperatures.

It is another object of the present invention to provide a simple method for manufacturing the label sheet.

In accordance with the present invention, a label sheet is provided which comprises an adhesive layer, an inorganic reinforcement layer, a polyester or polyimide film layer and a bar-code print layer on a releasable substrate layer in sequence.

In accordance with another aspect of the present invention, there is provided a method for manufacturing a label sheet comprising the steps of: (a) depositing a composition for a bar-code print layer, which is formed by mixing 80~95 wt % of silicone resin and 5~20 wt % of metal oxide, on a polyester or polyimide film layer, and drying the deposited resultant to form an upper layer including the bar-code print layer; (b) stacking an adhesive layer and an inorganic reinforcement layer on a releasable substrate layer in sequence to form a lower layer; and (c) attaching the polyester or polyimide film layer of the upper layer to the inorganic reinforcement layer of the lower layer.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
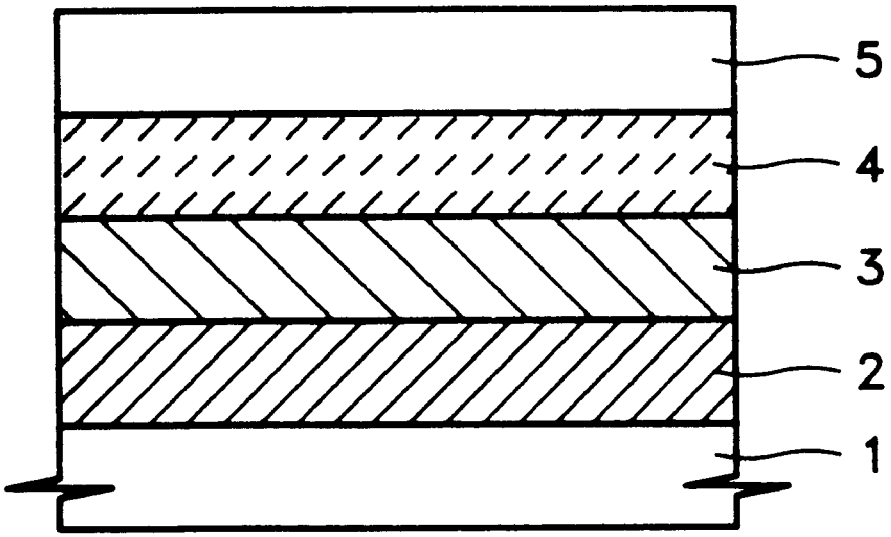
FIG. 1 is a schematic cross-sectional diagram of a label sheet according to the present invention.

As shown in FIG. 1 which is a cross-sectional diagram of a label sheet according to the present invention, an adhesive layer 2, an inorganic reinforcement layer 3, a polyester film layer 4 and a bar-code print layer 5 are stacked on a releasable substrate layer 1 in sequence. Film layer 4 may be made of polyimide.

In a preferred embodiment, the bar-code print layer has a thickness of 20~30 $\mu$m, and the bar-code print layer includes 80~95 wt % of silicone resin and 5~20 wt % of metal oxide. Also, the metal oxide is an oxide of metal selected from the group consisting of aluminum, zirconium, zinc and titanium.

The polyester film layer (or a "green tape layer," which is formed of polyester or polyimide) increases contrast of a print during printing of the bar-code and improves the flatness of the label sheet, wherein the thickness of the polyester or polyimide film layer is 15~25 $\mu$m.

In a preferred embodiment, a commercially available whisker may be used as the inorganic reinforcement layer. More preferably, a potassium titanate whisker or silicon nitride whisker is used as the inorganic reinforcement layer. Here, the diameter and length of the whisker may be properly selected according to the thickness of the intended label sheet.

Also in a preferred embodiment, the adhesive layer is 10~20 $\mu$m in thickness and includes an acryl resin and glass frit. Here, the content of the glass frit is 10~20 wt % based on the weight of the acryl resin.

The releasable substrate layer may be any material having good release properties. In a preferred embodiment, however, a silicone-coated paper is used as the releasable substrate layer, and wherein the thickness of the substrate layer is 70~90 $\mu$m.

A manufacturing method of the label sheet in accordance with the present invention will be described as follows. First, a silicone resin and a metal oxide are mixed to form a composition for the bar-code print layer 5. Here, the silicone resin is provided in liquid state, so that there is no need to add a solvent to the composition. However, an organic solvent may be added, if required, which, preferably, is toluene. The composition for the bar-code print layer 5 is deposited on the polyester or polyimide film layer 4 to form an upper layer including the bar-code print layer 5 of 20~30

μm thickness. That is, the upper layer is a two-layered structure including the polyester film layer and the bar-code print layer.

After forming an adhesive composition by mixing an acryl resin and a glass frit, the resulting adhesive composition then is deposited on a silicone-coated paper used as the substrate layer 1 to form the adhesive layer 2. The inorganic reinforcement layer 3 then is stacked on the adhesive layer 2 to form a lower layer which is a three-layered structure. Here, as the inorganic reinforcement layer 3, a silicon nitride whisker or potassium titanate whisker is used, wherein the whisker with a fibrous textile structure prevents the cracking of the sheet in a high-temperature firing furnace and increases the flexibility thereof.

Subsequently, the inorganic reinforcement layer 3 is attached to the polyester film layer 4 of the upper layer to complete the label sheet of the present invention. If the inorganic reinforcement layer 3 is stacked on the adhesive layer 2, the textile structure of adhesive layer 2 partially protrudes through the inorganic reinforcement layer 3 due to the textile structure of the inorganic reinforcement layer 3. As a result, the upper layer and the lower layer can attach to each other more firmly, and the unevenness of the lower layer after the formation of the inorganic reinforcement layer 3 can be compensated by the polyester film layer 4 of the upper layer.

In a preferred embodiment, the bar-code print layer has a thickness of 20~30 μm, and the metal oxide is an oxide of metal selected from the group consisting of aluminum, zirconium, zinc and titanium. It is also preferable that the thickness of the polyester film layer is 15~25 μm.

Also in a preferred embodiment, a commercially available whisker is used as the inorganic reinforcement layer, and more preferably, a potassium titanate whisker or silicon nitride whisker is used. Also in a preferred embodiment, the adhesive layer is 10~20 μm thick and includes an acryl resin and glass frit. Here, the content of the glass frit is 10~20 wt % based on the weight of the acryl resin.

Any material having good release properties may be used as the releasable substrate layer. In a preferred embodiment, however, a silicone-coated paper is used, wherein the thickness of the substrate layer is 70~90 μm.

The label sheet of the present invention can be manufactured with ease and is very stable at high-temperatures. Also, a metal oxide included in the bar-code print layer 5 protects the bar-code print layer 5 at a high-temperature. Furthermore, since a glass frit is included in the adhesive layer 2, not in the bar-code print layer 5, the problems caused by glass frit being included in a conventional bar-code print layer can be eliminated. Also, the glass frit of the adhesive layer 2 stabilizes the shape of the label sheet.

Hereinafter, the present invention will be described in detail with reference to preferred embodiments, however, this invention is not limited to the particular forms illustrated below.

The samples manufactured in the following examples and comparative examples are 60 mm long, 10 mm wide and 100 μm thick.

Example 1

80 g of silicone resin (KR 200 Series manufactured by Shin-Etsu Chemical Co.) and 20g of zirconium oxide were mixed with 10 g of toluene to form a composition for a bar-code print layer 5. This composition was deposited on a polyimide film layer 4 (Kapton® film paper, Model No. K1453A, manufactured by Dupont Co.) and then dried at room temperature for 24 hours, thereby forming an upper layer including the bar-code print layer having a thickness of approximately 25μm.

Then, acryl resin (No. 421, manufactured by Showha Polymer Co.) and glass frit (Model 8000L, manufactured by Shin Heung Ceramics) were mixed in a weight ratio of 85:15 to form an adhesive composition. Then, the obtained adhesive composition was deposited on a silicone-coated paper to form an adhesive layer 2. A potassium titanate whisker (TISMO Type D, manufactured by Otasuka Chemical) then was stacked on the adhesive layer 2 to form a lower layer, which is a three-layered structure. Here, the silicone resin of the composition for the bar-code print layer 2 and the potassium titanate whisker were mixed such that their weight ratio is 50:50.

Subsequently, the polyimide film layer 4 of the upper layer and an inorganic reinforcement layer 3 of the lower layer are attached to complete the label sheet (E1). Then, a bar-code is printed by a thermal transcription method.

Example 2

A label sheet (E2) was prepared in the same manner as in Example 1 except that titan oxide was used instead of zirconium oxide and the silicone resin of the composition for the bar-code print layer 5 and potassium titanate whisker were used in a weight ratio of 20:80.

Example 3

A label sheet (E3) was prepared in the same manner as in Example 1 except that zinc oxide and silicon nitride whisker (manufactured by Otsuka Chemical) were used instead of zirconium oxide and potassium titanate whisker, respectively, and the silicone resin of the composition for the bar-code print layer 5 and silicon nitride whisker were used in a weight ratio of 20:80.

Example 4

A label sheet (E4) was prepared in the same manner as in Example 1 except that aluminum oxide was used instead of zirconium oxide and the silicone resin of the composition for the bar-code print layer 5 and potassium titanate whisker were used in a weight ratio of 80:20.

Example 5

A label sheet (E5) was prepared in the same manner as in Example 1 except that silicon nitride whisker was used instead of potassium titanate whisker and the silicon resin of the composition for the bar-code print layer and silicon nitride whisker were used in a weight ratio of 80:20.

Comparative Example 1

A label sheet (Cl) was prepared in the same manner as in Example 1 except that an alkide resin (SA-4, manufactured by Shin-Etsu) was added to the adhesive composition instead of the acryl resin.

Comparative Example 2

A label sheet (C2) was prepared in the same manner as in Example 1 except that a glass frit was not added to the adhesive composition.

Comparative Example 3

A label sheet (C3) was prepared in the same manner as disclosed in U.S. Pat. No. 4,775,786.

Various characteristics of the label sheets manufactured in the above examples and comparative examples were tested according to the following methods and the results are shown in Table 1.

1. Tests of the Label Sheet Itself

The following tests were performed on the label sheet itself.

1) Visual inspection: Surface luster, and printing state of bar-code were visually inspected.

2) Drying time: Time required for completely drying an intermediate after depositing the composition for the bar-code print layer on the inorganic reinforcement layer 3 at room temperature was measured and then the label sheets were classified according to the measured drying time as follows: excellent (within 10 minutes); good (10–30 minutes); moderate (30–60 minutes); and poor (over 60 minutes)

3) Flexibility: The flexibility of the label sheet was tested by measuring the degree of change of a label sheet when its one side was distorted by a rotator where the other side was fixed.

2. Test of the Label Sheets After a Thermal Process

The characteristics of the label sheets were measured after performing a thermal process with respect to the label sheets which were attached to an article. Here, a high temperature furnace used for the thermal process was heated and cooled according to the following conditions: The temperature was raised to a maximum temperature of 460° C. over a 15 minute period; the maximum temperature was maintained for 10 minutes; and the temperature was lowered from 460° C. to room temperature in 20 minutes.

1) Visual inspection: Cracking, color change, surface state and printing state of bar-code were visually inspected.

2) Adhesion: The adhesion between the label sheet and the article was measured by using a glass nod.

3) Smearing of the printed bar-code: The smearing characteristic of the printed bar-code was tested by rubbing a printed bar-code by hand.

TABLE 1

| | | test samples | | | | | | | |
|---|---|---|---|---|---|---|---|---|---|
| state | tests | E1 | E2 | E3 | E4 | E5 | C1 | C2 | C3 |
| after molding | surface luster | ○ | ● | ○ | ○ | ○ | ○ | ○ | ● |
| | cracking | ● | ○ | ○ | ○ | ○ | ○ | ○ | ◇ |
| | dry-time | ○ | ○ | ○ | ○ | ○ | ○ | ○ | x |
| | printing state of bar-code | ○ | ○ | ○ | ○ | ○ | ○ | ○ | ○ |
| | flexibility | ● | ● | ○ | ● | ○ | ● | ● | x |
| after thermal processing | cracking | ○ | ○ | ○ | ○ | ○ | ◇ | ○ | ◇ |
| | color change | ○ | ○ | ○ | ● | ● | ○ | ○ | ◇ |
| | surface state | ○ | ● | ○ | ○ | ○ | ○ | ○ | ○ |
| | printing state of bar-code | ○ | ● | ○ | ○ | ○ | ○ | ○ | ○ |
| | smearing of printed bar-code | ● | ○ | ○ | ○ | ○ | ○ | ○ | x |
| | adhesiveness | ○ | ○ | ○ | ○ | ○ | x | x | ● |

Note:
● excellent, ○ good, ◇ moderate, x poor

From the results shown in Table 1, the flexibility and the color of the label sheet are affected by the content of the silicon region included in the bar-code print layer 5. However, if the content of the silicone resin is within the above defined range of the present invention, the silicon resin does not cause any special problems. On the other hand, when an adhesive including alkide resin is used, the label sheet does not attach to the article completely due to inferior adhesion of the adhesive to the article. Also, when an adhesive without the glass frit is used, the adhesion is poor. Consequently, it is preferable to use silicone resin, inorganic reinforcement and adhesive including glass frit in a weight ratio as defined above.

As described above, according to the label sheet of the present invention, the glass frit is added to the adhesive layer, and not to the bar-code print layer, so that the conventional problems caused from the glass frit in the bar-code print layer 5 can be eliminated and the adhesive layer itself can fix the shape of the label sheet. In addition, thermal stability at high temperatures is improved by the characteristics of individual layers constituting the label sheet, so that the printing state of the bar-code is not deteriorated by a thermal process.

What is claimed is:

1. A label sheet which comprises:

(a) an adhesive layer, (b) an inorganic reinforcement layer, (c) a polyimide film layer, and (d) a bar-code print layer, wherein all of said layers are separate and joined in sequence on top of a substrate layer, and wherein said adhesive layer is in releasable contact with said substrate layer.

2. A label sheet as claimed in claim 1, wherein said bar-code print layer has a thickness of 20~30$\mu$m.

3. A label sheet as claimed in claim 1, wherein said bar-code print layer includes 80~95 wt % of silicone resin and 5~20 wt % of metal oxide.

4. A label sheet as claimed in claim 3, wherein said metal oxide is an oxide of metal selected from the group consisting of aluminum, zirconium, zinc and titanium.

5. A label sheet as claimed in claim 1, wherein said inorganic reinforcement layer is formed of one whisker selected from the group consisting of potassium titanate whisker and silicon nitride whisker.

6. A label sheet as claimed in claim 5, wherein said inorganic reinforcement layer has a thickness of 10~20$\mu$m.

7. A label sheet as claimed in claim 1, wherein said adhesive layer includes an acryl resin and glass frit.

8. A label sheet as claimed in claim 7, wherein the content of said glass frit is 10~20 wt % based on the weight of said acryl resin.

9. A label sheet as claimed in claim 1, wherein said releasable substrate layer is formed of a silicone-coated paper.

* * * * *